United States Patent [19]

Baker

[11] 4,206,522

[45] Jun. 10, 1980

[54] AUTOMATED SURGE WEIR AND RIM SKIMMING GUTTER FLOW CONTROL SYSTEM

[76] Inventor: William H. Baker, 30 Honeysuckle Woods, Clover, S.C. 29710

[21] Appl. No.: 867,737

[22] Filed: Jan. 9, 1978

Related U.S. Application Data

[63] Continuation-in-part of Ser. No. 640,825, Dec. 15, 1975, abandoned, and Ser. No. 663,161, Mar. 2, 1976, abandoned.

[51] Int. Cl.[2] ..... E04H 3/16; E04H 3/20

[52] U.S. Cl. ..... 4/512; 210/105; 210/169

[58] Field of Search ..... 4/172, 172.15, 172.16, 4/172.17; 210/169, 102, 104, 105, 123, 126; 137/386

[56] References Cited

U.S. PATENT DOCUMENTS

| | | | |
|---|---|---|---|
| 1,800,378 | 4/1931 | Everson | 210/169 X |
| 2,809,752 | 10/1957 | Leslie | 4/172.17 |
| 3,386,107 | 6/1968 | Whitten | 4/172 |
| 3,537,111 | 11/1970 | Whitten | 4/172.17 |
| 3,668,713 | 6/1972 | Baker | 4/172.17 |
| 3,739,405 | 6/1975 | Schmidt | 4/172.15 |
| 3,815,160 | 6/1974 | Baker | 4/172 X |
| 3,848,627 | 11/1974 | Page | 4/172.17 X |
| 3,895,402 | 7/1975 | Page | 4/172.17 |
| 3,908,207 | 9/1975 | Van den Brock | 4/172.17 |

FOREIGN PATENT DOCUMENTS

| | | | |
|---|---|---|---|
| 16917 | 3/1934 | Australia | 4/172.17 |

*Primary Examiner*—Stuart S. Levy

[57] ABSTRACT

An automated skimming flow perimeter gutter control system for swimming pools is provided having a water cleaning and recirculation system receiving water from the pool, cleaning it, and returning it to the pool; a first drain line connecting the pool to the water recirculation system for water feed from the pool for cleaning; a gutter conduit for disposition about the perimeter of a swimming pool, receiving overflow across a top edge thereof and adapted to carry water at a level below a predetermined level in the swimming pool; a second drain line connecting the gutter conduit with the water recirculation system for water feed from the gutter for cleaning; skimming means receiving skimming flow across a top edge thereof at the perimeter of the swimming pool; a first drain valve in the first drain line which when open allows water from the pool to flow to the water recirculation system, and when closed stops such flow; a balance means in flow connection with the first and second drain lines and the water recirculation sytem, receiving pool water via each drain line, blending the pool waters, and flowing the blended waters to the water recirculation system; and at least one water level-responsive sensor sensing and directly responding to the level of water in the balance means and adjusting the water recirculation flow from the pool and from the gutter to increase water recirculation system capacity for flow from the gutter and prevent gutter water flooding back from the gutter to the pool.

55 Claims, 8 Drawing Figures

FILTER

AUTOMATED SURGE WEIR AND RIM SKIMMING GUTTER FLOW CONTROL SYSTEM

This application is a continuation-in-part of Ser. No. 640,825, filed Dec. 15, 1975, and of Ser. No. 663,161, filed Mar. 2, 1976, both now abandoned.

Automatic control at all times of the water level in a pool requires prompt response to changes in operating conditions, and is not easy to achieve. Many attempts have been made, but a fully automated response to all use conditions has not in fact been obtained.

Establishment and maintenance of the water level in a pool when the pool is quiescent is relatively easy. One system for automatically maintaining pool level, sensing pool level by a float in a surge and level control tank, and feeding make-up water to the pool by a float-operated valve, is described in U.S. Pat. No. 3,386,107 to G. R. Whitten Jr., patented June 4, 1968. It is desirable of course to avoid placing a float directly in the pool, since not only would a float be in the way of swimmers, but the float would also be subject to changes in water level due to wave action. These problems are avoided by placing the float in a separate surge and level control tank, connected to the pool below the surface, so that the control responds only to static pool level. When the static level is below a predetermined level, make-up water is added even though the pool surface may be turbulent. In the system of this patent, the make-up water is added to the control chamber in the tank, in which the float sinks to detect a low water level, and excess water is also withdrawn by overflow or drain provided through the control tank. However, as noted by Whitten Jr. in a later U.S. Pat. No. 3,537,111 patented Nov. 3, 1970, the cost of such an elaborate surge and level control tank adds substantially to the total construction cost of the pool.

A further system noted by Whitten Jr. in U.S. Pat. No. 3,537,111 is to provide a sump separated from the pool by a ledge which sets a level for overflow, and a make-up water supply valve feeding directly into the sump under the control of a float. A drain valve is connected to the same float for draining the sump to a recirculating pump whenever the sump tends to overfill. However, this system does not correct flooding of the sump to the pool level by rain or overfilling, and no peripheral gutter is provided in this system, which also requires the construction of a separate sump tank which has to be placed at pool side, rather than located remotely at a location which would be both more convenient and less obstructive of the deck around the pool.

Accordingly, in U.S. Pat. No. 3,537,111, patented Nov. 3, 1970, Whitten Jr. proposed a modified system in which all water level sensors sense water level in the drainage gutter, and not in the pool. The level of drainage flow in the single peripheral gutter is detected at one level or a range of levels. The gutter has an overflow lip or weir for skimming flow at the desired pool height, and delivers overflow to a recirculating pump and filter, which may also draw water from drains under the pool surface. The detecting means controls a valve in a make-up water supply line which either feeds the pool directly, or feeds the recirculating pump, if prefiltration is desired. The control is arranged to open the make-up valve, if the drainage flow falls below a level that will guarantee maintenance of continuous overflow all around the periphery of the pool, taking the provision of a hydraulic gradient in the gutter into account. If the drainage flow rises beyond a normal operating level, which is sufficiently lower than the gutter lip to allow ample space in the gutter to receive abnormal flow caused by pool surge, the control closes the make-up valve and discontinues the supply to the pool.

Means is also provided for increasing the rate of drainage of the gutter under flooding conditions, detecting the level of the drainage flow to control the main drain valve. The control is arranged to partially close the main drain valve to reduce the proportion of the recirculating flow which is drawn from the main drain whenever the gutter flow substantially fills the gutter space reserved for surge and approaches the level of the overflow drain pipe. The effect of this is to increase the rate of flow taken by the recirculating pump from the gutter, and thus hasten a drop in the drainage overflow in the gutter to a suitable operating level. As this level returns to normal, the control reopens the main drain valve to restore the original proportioning of the recirculating flow taken from the gutter and the pool.

The system does however have an inadequate gutter capacity to respond to high gutter flooding conditions.

Higher than normal pool levels, substantially higher than the overflow lip of the gutter, must be prevented from entering the gutter, therefore, by covering the gutter with a grille having drain holes whose total area is calculated to admit only the maximum recirculation flow rate that can be handled by the gutter. Such water is retained on the grille, and accordingly washes back to the pool without entering the gutter, which is undesirable, since this washes dirt and debris collected on the grille back into the pool, and accordingly fails to meet modern health code requirements.

In order to prevent this, it is necessary to provide a gutter system of considerably increased capacity, such a double gutter of the type provided, for example, in U.S. Pat. Nos. 3,668,712, 3,668,713, 3,668,714 and 3,815,160 to Baker. However, the control system of No. 3,537,111 is not suitable for use in a double gutter pool.

In accordance with the invention of Ser. No. 640,825, a fully automated water level and skimming flow perimeter gutter control system for swimming pools is provided, comprising a gutter receiving overflow, including surge flow and/or skimming flow, across the top of the perimeter gutter and adequate for normal and surge flow conditions, and optionally, a second gutter receiving skimming flow and also providing additional gutter capacity for extraordinary overflow, including relief flow from the first gutter in the event of considerable activity in the pool, in combination with a level-sensing pool and overflow control system operating from the level of water in the pool and from the level of water in the pool overflow, such as in the gutter conduit, or in a balance tank or a vacuum filter tank, to control the skimming flow and water recirculation between the pool and the gutter, and feed from a water-make-up supply.

In accordance with the present invention, a fully automated surge weir and rim skimming flow perimeter gutter control system for swimming pools is provided, comprising a gutter receiving overflow, including surge flow and rim skimming flow, across the top of the perimeter gutter and adequate for normal and surge flow conditions, and optionally a second gutter receiving skimming flow and also providing additional gutter capacity for extraordinary overflow, including relief flow from the first gutter in the event of considerable activity in the pool, in combination with a level-sensing pool overflow control system operating from the level of water in the pool overflow, such as in the gutter conduit, or in a balance tank or a vacuum filter tank, to control at least one of the surge weir and rim skimming flow and/or water recirculation flow between the pool and the gutter, and optionally, in addition, water feed from a water make-up supply.

The flow control system of this invention accommodates any increase in pool activity above the quiescent condition that results in a greater-than-normal skimming flow through the surge weirs and/or over the rim into the skimming gutter, and that in turn causes the pool water overflow level to rise, in the gutter and elsewhere downstream.

In the event the gutter system includes one or more surge weirs, arranged in weir passages, an overflow sensor is provided, such as in the gutter, responsive to a pool overflow water level corresponding to a low activity pool condition, above the normal surge weir skimming flow level (which can be sensed in the pool by a pool sensor). When the pool overflow level reaches the level of this overflow sensor, the sensor actuates a mechanism closing off the surge weirs, arresting skimming flow through the weirs, and retaining the water in the pool, but allowing skimming flow and/or flow surges to proceed across the top rim of the pool perimeter, into the gutter.

A further increase in pool activity to a higher level corresponding to moderate pool activity will increase the overflow water level such as in the gutter. If a two-gutter system is provided, the water level in the first gutter will eventually reach the flooding level, and thus an overflow connection is provided between the first and second gutters, so that such water instead of flooding the first gutter and returning to the pool flows from the first gutter to the second gutter.

In the event provision is made to increase or decrease water recirculation flow according to pool activity, a response is provided when pool activity is moderate.

Under moderate pool activity, there is more water overflow, and this overflow taxes the normal water recirculation system, which may receive flow not only from the gutter but also from the main drain in the pool. Consequently, the overflow water level, such as in the gutter, rises, until it encounters a sensor at a predetermined overflow water level, a sensor which controls the position of a recirculating flow throttling control valve on the return line of the recirculation system. This valve can at normal quiescent or light pool activity provide a normal recirculation flow, but upon demand, at moderate or heavy pool activity, the valve can be actuated by the second sensor to provide a higher recirculation flow. The throttling valve thus makes it possible to design the recirculation system to accommodate any excess flow above the normal recirculation rate, as may be required according to the amount of pool activity to be expected, or the amount of skimming flow through any weirs and/or across the top of the perimeter rim.

Alternatively, or in addition, this sensor can be put in operating connection with the main drain valve, and when this water level is reached, the water recirculation system capacity for gutter flow can be increased by closing off the main drain valve, causing all recirculation water between the pool and the pool recirculation system to flow into the system from the gutter.

If the throttling control valve were not opened, or if the recirculating flow main drain were not cut off, the recirculation system would be unable to accommodate the increased overflow, and the overflow would begin to back up in the gutter system. Consequently, this sensor prevents flooding of the gutters and back-wash to the pool under the increased overflow, as a result of this higher level of activity.

Upon a further increase in pool activity, to the maximum, i.e., operation of the pool at the rim flow level, providing skimming flow across the top of the gutter, the amount of overflow into the gutter increases still further. Eventually, such activity raises the overflow water level such as in the gutter to an overflow water level at which the capacity of the recirculation system is again exceeded, and must be increased further, to prevent gutter flooding and wash-back. At this point an overflow sensor is actuated which further increases recirculating flow, either by opening the recirculating flow throttling control valve on the return line of the recirculation system, to increase the amount of water drawn through the filter, and/or by opening the main drain valve (if not opened previously) and/or by opening a bypass line to bypass the filter, so as to permit the recirculation system to accommodate the excess overflow generated under such conditions.

An optional feature is control of normal pool water level. For this purpose (as in Ser. No. 640,825) two sensors are provided. An overflow sensor senses a level of water in the overflow, such as in the gutter or balance tank or vacuum filter tank, corresponding to a predetermined below-normal skimming flow, and when this level is reached, opens a make-up valve controlling feed of fresh water from a supply or the water main. A pool sensor senses the level of the water in the pool, and is arranged to close the make-up water valve whenever the pool water level reaches a predetermined normal quiescent level at which skimming flow via surge weirs or a skimming gutter proceeds, and overflows into the gutter. This equilibrium condition continues while skimming flow remains at a rate corresponding to a quiescent pool condition.

The several sensors can be double-acting, i.e., actuated at their predetermined water level, whether that level is reached by a declining flow or by a rising flow, or single-acting, in which case one set of sensors responds to rising level and a second set of sensors can be used if desired responding to declining flow, or a combination of both. Consequently, a declining flow can be made to reverse the sequence of actuation response noted above.

Accordingly, the control system in accordance with the invention makes it possible automatically to accommodate any amount of pool activity without gutter flooding or washing back of debris and contaminants in the gutters into the pool, permitting skimming flow through surge weirs and/or over the perimeter rim, as may be desired.

One embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and an overflow sensor sensing a water level in the overflow downstream of the pool characteristic of a low threshold of pool activity, but excessive weir skimming flow, and arranged to close at least one weir.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit, the top rim of the wall being placed at a height to maintain a predetermined water level in the pool, to provide a skimming flow of water at such predetermined water level in the pool, and to allow excessive flows, wave actions and surges to flow over the top rim of the wall into the gutter conduit; a water cleaning and recirculating system for collecting water from the pool and water flowing into and along the gutter conduit, cleaning it, and returning it to the pool; and an overflow sensor sensing an overflow level characteristic of an above-normal skimming flow and corresponding to a level of pool activity above a normal quiescent pool condition, and arranged to increase water recirculation system capacity to accommodate such increased overflow, and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges to flow over the top rim of the wall into the gutter conduit; a water cleaning and recirculating system for collecting water from the pool and water flowing into and along the gutter conduit, cleaning it, and returning it to the pool; and an overflow sensor sensing an overflow level characteristic of an above-normal skimming flow and corresponding to a level of pool activity above a normal quiescent pool condition, and arranged to increase water recirculation system capacity to accommodate such increased overflow, and prevent wash-back from a gutter conduit to the pool.

To avoid the restriction of a limited flow through a filter, a bypass line can be incorporated to allow some or all such excess flow to bypass the filter.

A further embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit, the top rim of the wall being placed at a height to maintain a predetermined water level in the pool, to provide a skimming flow of water over the top rim at such predetermined water level in the pool, and to allow excessive flows, wave actions and surges to flow over the top rim of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; and an overflow sensor sensing a higher level in the overflow downstream of the pool characteristic of an above-normal water flow, wave action and surges into the gutter conduit, and arranged to adjust the water recirculation throttling valve to increase recirculation system capacity to accommodate such increased overflow, and prevent wash-back from a gutter conduit to the pool.

A preferred embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a second gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into a gutter conduit; the top rim of the wall being placed at a height to maintain a predetermined water level in the pool, to provide a skimming flow of water at such predetermined water level in the pool, and to allow excessive flows, wave actions and surges to flow over the top rim of the wall into a gutter conduit; a water cleaning and recirculating system for collecting water from the pool and water flowing into and along the first and second gutter conduits, cleaning it, and returning it to the pool; and an overflow sensor sensing a water level in the overflow downstream of the pool characteristic of a high degree of water flow, wave action and surges into the gutter conduit, and arranged to increase water recirculation system capacity to recirculate such increased overflow and prevent wash-back from a gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; the top rim of the wall being placed at a height to maintain a predetermined water level in the pool, to provide a skimming flow of water over the top rim of the wall at such predetermined water level in the pool, and allow excessive flows, wave actions and surges to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; and an overflow sensor sensing a water level in the overflow downstream of the pool characteristic of a high degree of water flow, wave action and surges into the first gutter conduit, and arranged to adjust the water circulation throttling valve to increase recirculation system capacity to accommodate such increased overflow, and prevent wash-back from a gutter to the pool.

Another embodiment of automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit, a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; and an overflow sensor sensing a water level in the overflow downstream of the pool characteristic of a low threshhold of pool activity but excessive weir skimming flow, and arranged to close at least one weir.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a first gutter sensor sensing a first water level in a gutter characteristic of a low threshhold of pool activity but excessive weir skimming flow, and arranged to close at least one weir; and a second sensor sensing a second higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

Another embodiment of automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first sensor sensing a first water level in the second gutter characteristic of a low threshhold of pool activity but excessive weir skimming flow, and arranged to close at least one weir; and a second sensor sensing a second higher level in the second gutter characteristic of a high degree of water flow, wave action and surges into the first gutter conduit, and arranged to adjust the water recirculation throttling valve to increase water recirculation system capacity to recirculate such increased gutter flow and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; a first overflow sensor sensing a first water level in the overflow downstream of the pool characteristic of a low threshhold of pool activity but excessive weir skimming flow, and arranged to close at least one weir; a second overflow sensor sensing a second higher level in the overflow downstream of the pool characteristic of a high degree of water flow, wave action and surges into the gutter conduit, and arranged to increase water recirculation system capacity to recirculate such increased gutter flow; and a third overflow sensor sensing a third higher level in the overflow downstream of the pool characteristic of a higher degree of water flow, wave action and surges into the gutter conduit; and arranged to adjust the water recirculation throttling valve to increase recirculation system capacity to accommodate such increased overflow, and prevent wash-back from the gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first gutter sensor sensing a higher water level in a gutter characteristic of a low threshhold of pool activity but excessive weir skimming flow, and arranged to close at least one weir; a second sensor sensing a higher level in a gutter characteristic of a high degree of water flow, wave action and surges into the first gutter conduit, and arranged to increase water recirculation system capacity to recirculate such increased gutter flow to the pool; and a third sensor sensing a higher level in a gutter characteristic of a higher degree of water flow, wave action and surges into the conduit, and arranged to adjust the water recirculation throttling valve to increase recirculation system capacity to accommodate such increased gutter flow, and prevent wash-back from a gutter conduit to the pool.

A further feature of the control system in accordance with the invention is the provision of an overriding control such as an electric switch, to make it possible to operate skimming flow either through weirs or over the perimeter rim, as desired, while retaining any and all other automatic controls, to accommodate any amount of pool activity without gutter flooding or washing back of debris and contaminants in the gutters into the pool, permitting skimming flow through surge weirs and/or over the perimeter rim, as may be desired.

One embodiment of such a pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; an overflow sensor sensing a water level in the overflow downstream of the pool characteristic of a low threshhold of pool activity, but excessive weir skimming flow, and arranged to close at least one weir; and means overriding the overflow sensor to close the weir and direct all skimming flow over the top rim of the retaining wall.

Another embodiment of such a pool perimeter skimming gutter water level control system of the invention, utilizing a twin-gutter pool perimeter skimming gutter, comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; an overflow sensor sensing a water level in the overflow downstream of the pool characteristic of a low threshhold of pool activity but excessive weir skimming flow, and arranged to close at least one weir; and means overriding the overflow sensor to close the weir and direct all skimming flow over the top rim of the retaining wall.

Another embodiment of such a twin-gutter pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a first gutter sensor sensing a first water level in a gutter characteristic of a low threshhold of pool activity but excessive weir skimming flow, and arranged to close at least one weir; means overriding the overflow sensor to close the weir and direct all skimming flow over the top rim of the retaining wall; and a second sensor sensing a second higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

Another embodiment of such a twin-gutter pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a sweimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first sensor sensing a first water level in the second gutter characteristic of a low threshhold of pool activity but excessive weir skimming flow, and arranged to close at least one weir; means overriding the overflow sensor to close the weir and direct all skimming flow over the top rim of the retaining wall; and a second sensor sensing a second higher level in the second gutter characteristic of a high degree of water flow, wave action and surges into the first gutter conduit, and arranged to adjust the water recirculation throttling valve to increase water recirculation system capacity to recirculate such increased gutter flow and prevent wash-back from a gutter conduit to the pool.

Another embodiment of such a pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; a first overflow sensor a first water level in the overflow downstream of the pool characteristic of a low threshhold of pool activity but excessive weir skimming flow, and arranged to close at least one weir; means overriding the overflow sensor to close the weir and direct all skimming flow over the top rim of the retaining wall; a second overflow sensor sensing a second higher level in the overflow downstream of the pool characteristic of a high degree of water flow, wave action and surges into the gutter conduit, and arranged to increase water recirculation system capacity to recirculate such increased gutter flow; and a third overflow sensor sensing a third higher level in the overflow downstream of the pool characteristic of a higher degree of water flow, wave action and surges into the gutter conduit; and arranged to adjust the water recirculation throttling valve to increase recirculation system capacity to accommodate such increased overflow, and prevent wash-back from the gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first gutter sensor sensing a higher water level in a gutter characteristic of a low threshhold of pool activity but excessive weir skimming flow, and arranged to close at least one weir; means overriding the overflow sensor to close the weir and direct all skimming flow over the top rim of the retaining wall; a second sensor sensing a higher level in a gutter characteristic of a high degree of water flow, wave action and surges into the first gutter conduit, and arranged to increase water recirculation system capacity to recirculate such increased gutter flow to the pool; and a third sensor sensing a higher level in a gutter characteristic of a higher degree of water flow, wave action and surges into the conduit, and arranged to adjust the water recirculation throttling valve to increase recirculation system capacity to accommodate such increased gutter flow, and prevent wash-back from a gutter conduit to the pool.

The weir or weirs for skimming flow can be skimming slots, as in U.S. Pat. Nos. 3,668,712 and 3,668,714, the slots feeding water directly into the second gutter conduit.

The overflow level can be sensed by overflow sensors at any position downstream of the pool where a water level correlated with pool activity and skimming flow exists, and can be detected. One such location is in the gutter. If there be more than one gutter, the second gutter downstream of the first gutter is preferred, but any gutter can be used. Another location is in a balance tank or vacuum filter tank before the pump receiving gutter flow in the water recirculation system.

The water level sensing and control system of the invention is applicable to any design of single or multiple gutter perimeter gutter system.

U.S. Pat. No. 3,668,712 to William H. Baker dated June 13, 1972, provides a perimeter skimming gutter for swimming pools including a gutter conduit for disposition about the perimeter of a swimming pool and adapted to carry water at a level below a predetermined level of water in the swimming pool, a retaining wall on the pool-side of the conduit, over the top of which wall water may flow from the pool into the gutter conduit, and a plurality of narrow elongated substantially horizontally disposed openings through the wall at a height to maintain a predetermined water flow, the top of the wall being spaced above the openings at a height to retain the pool water within the pool perimeter at water flows, wave actions and surges up to a predetermined maximum, while allowing excessive water flows, wave actions and surges beyond such maximum to flow over the top of the wall into the gutter conduit.

U.S. Pat. No. 3,668,714 to William H. Baker dated June 13, 1972, provides a nonflooding perimeter skimming gutter for swimming pools including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit adapted to carry water at a level below a predetermined level of water in the first gutter conduit, and a fluid flow connection between the two gutter conduits at such level and below the top of the retaining wall allowing water flow from the first gutter conduit into the second gutter conduit whenever the water level on the first gutter conduit reaches the fluid flow connection, thereby inhibiting filling of the first gutter conduit appreciably above such level.

Both skimming gutter designs are quite satisfactory for most sizes of swimming pool. If their unusually large gutter capacity can at times be exceeded, then the gutter of U.S. Pat. No. 3,815,160 to William H. Baker, dated June 11, 1974, can be used.

This nonflooding perimeter skimming gutter wall permits an adequate skimming action at all times, and also provides for virtually unlimited surge capacity when the pool is in use, without the possibility of the gutter's flooding, or dirt in the gutter's being washed back into the pool. This is accomplished by combining a second gutter conduit within a peripheral wall of the swimming pool, making available for gutter flow the internal volume of the wall, in fluid flow connection with the first gutter conduit, and adapted to receive water from the first gutter conduit whenever the level of water in that gutter exceeds a predetermined maximum, established at the level of the fluid flow connection therebetween. This fluid flow connection is below the top of the retaining wall, so that the water level in the first gutter conduit cannot reach the top of the retaining wall. The second gutter conduit within the wall is entirely separate from the first, and is designed to provide an ample reserve flow capacity to accommodate any heavy or surge action that may be likely to be encountered. The fluid flow connection between the gutter conduits can be arranged to skim the dirt off the top of the first gutter trough, thus assisting in preventing this dirt from being washed back into the pool.

In this gutter system, the water level in the pool is normally maintained at the level at the top of the retaining wall, which consequently serves as a skimmer gutter at the pool perimeter. The fluid flow connection may constitute a second skimming flow outlet, supplementing and continuing the skimming action of the first.

The term "conduit" as used herein is inclusive of open conduits or troughs as well as partially or wholly enclosed conduits.

In a preferred embodiment of the invention the first gutter conduit is an open trough, with at least one fluid flow connection with the second gutter conduit in the form of one of a plurality of openings at the predetermined maximum level of water in the first gutter conduit.

The second gutter conduit preferably is a closed conduit. The second gutter conduit can be within any peripheral wall of the pool. It can, for example, be within the peripheral pool-side retaining wall. It can also be within a peripheral external wall of the gutter, on the side away from the pool.

In a preferred embodiment of the invention, a water-feed conduit is provided in the gutter for feed of fresh water into the pool. This conduit is preferably an integral part of the nonflooding perimeter skimming gutter, at the pool-side retaining wall, admitting water to the pool through the pool-side retaining wall.

In the case where the two gutters are separated by a common wall, the fluid flow connection between the two gutters can be of any configuration, and is in sufficient number and at a high enough level to provide for an adequate flow capacity, to prevent the water level in the first gutter conduit from appreciably exceeding the height of the overflow connection under any water surge or wave conditions in the pool.

The level of the overflow connections with respect to the bottom of the first gutter conduit can be adjustable, so as to provide adjustment of the water level permitted in the first gutter conduit before flow via the overflow connections into the second gutter conduit commences. This adjustment can be provided for by forming the overflow connections as vertical slots or with an extended vertical height, and disposing a movable barrier member over the overflow connections with the opening or openings of the desired size and shape.

A preferred embodiment of the invention is shown in the drawings in which.

Figure 1:
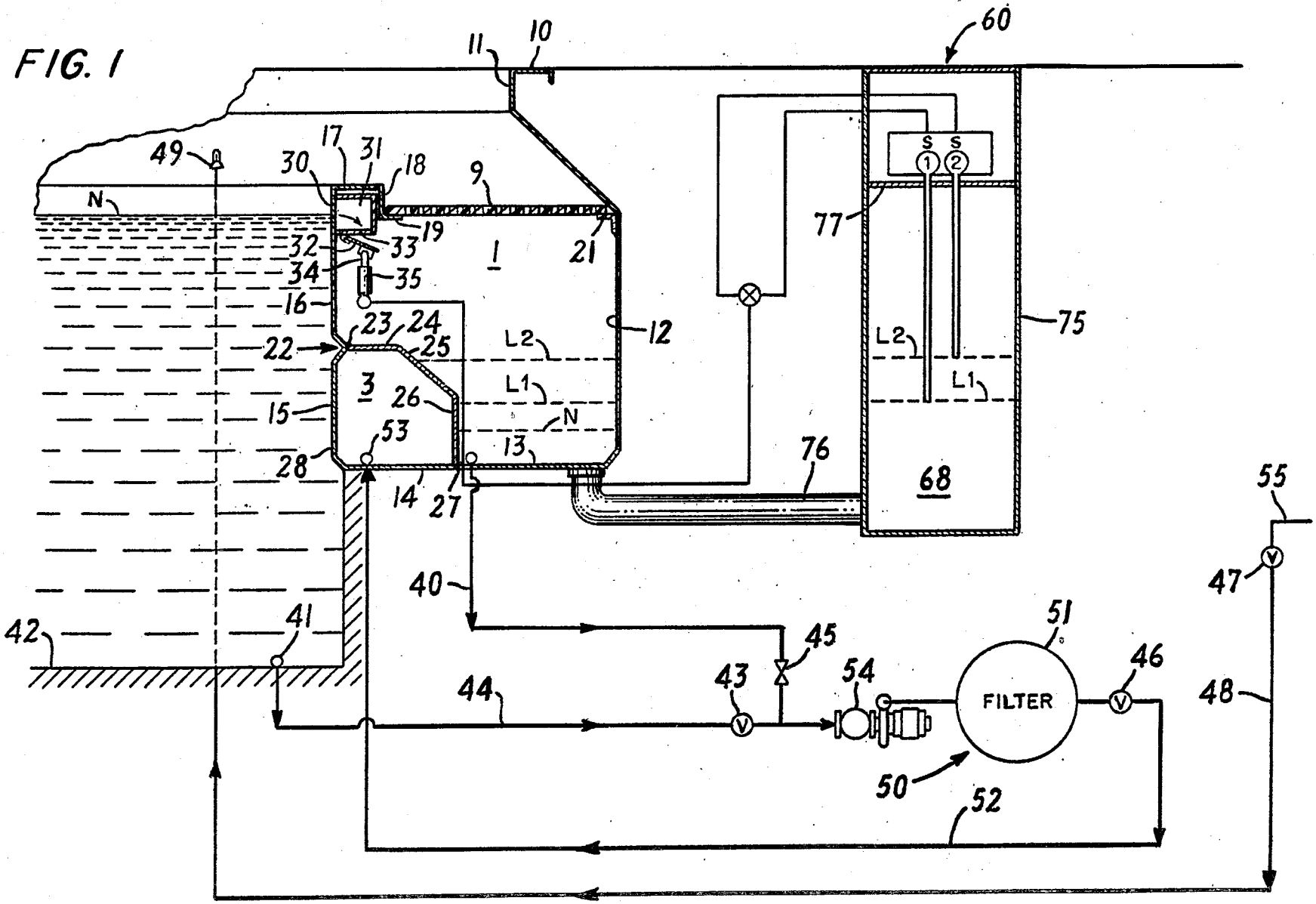
FIG. 1 is a pool water flow circuit diagram, showing a single gutter pool perimeter water recirculation system with a two-sensor automated control system of the invention imposed thereon.
Figure 2:
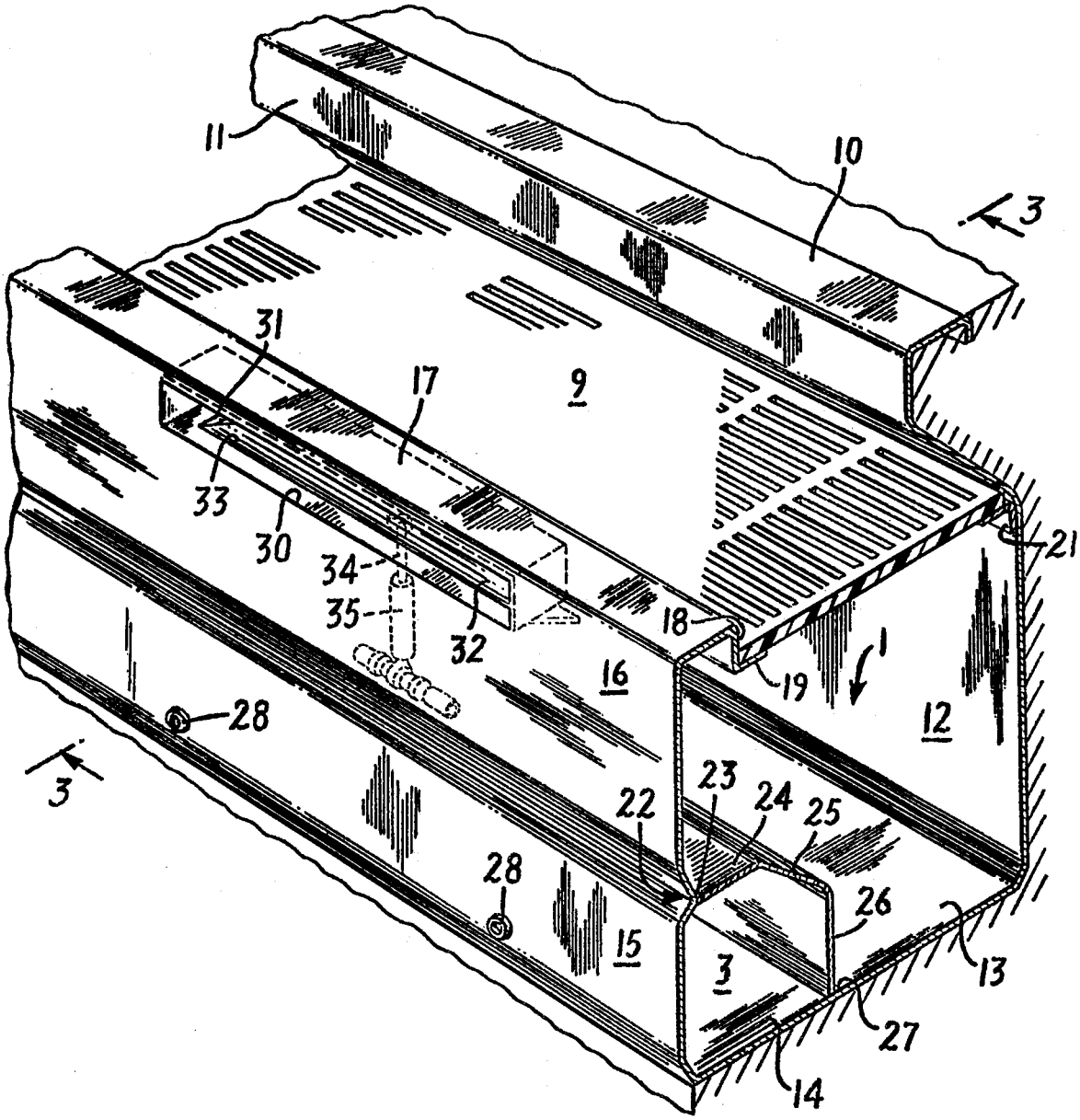
FIG. 2 represents a view of one modular unit of a pool perimeter gutter of FIG. 1.
Figure 3:
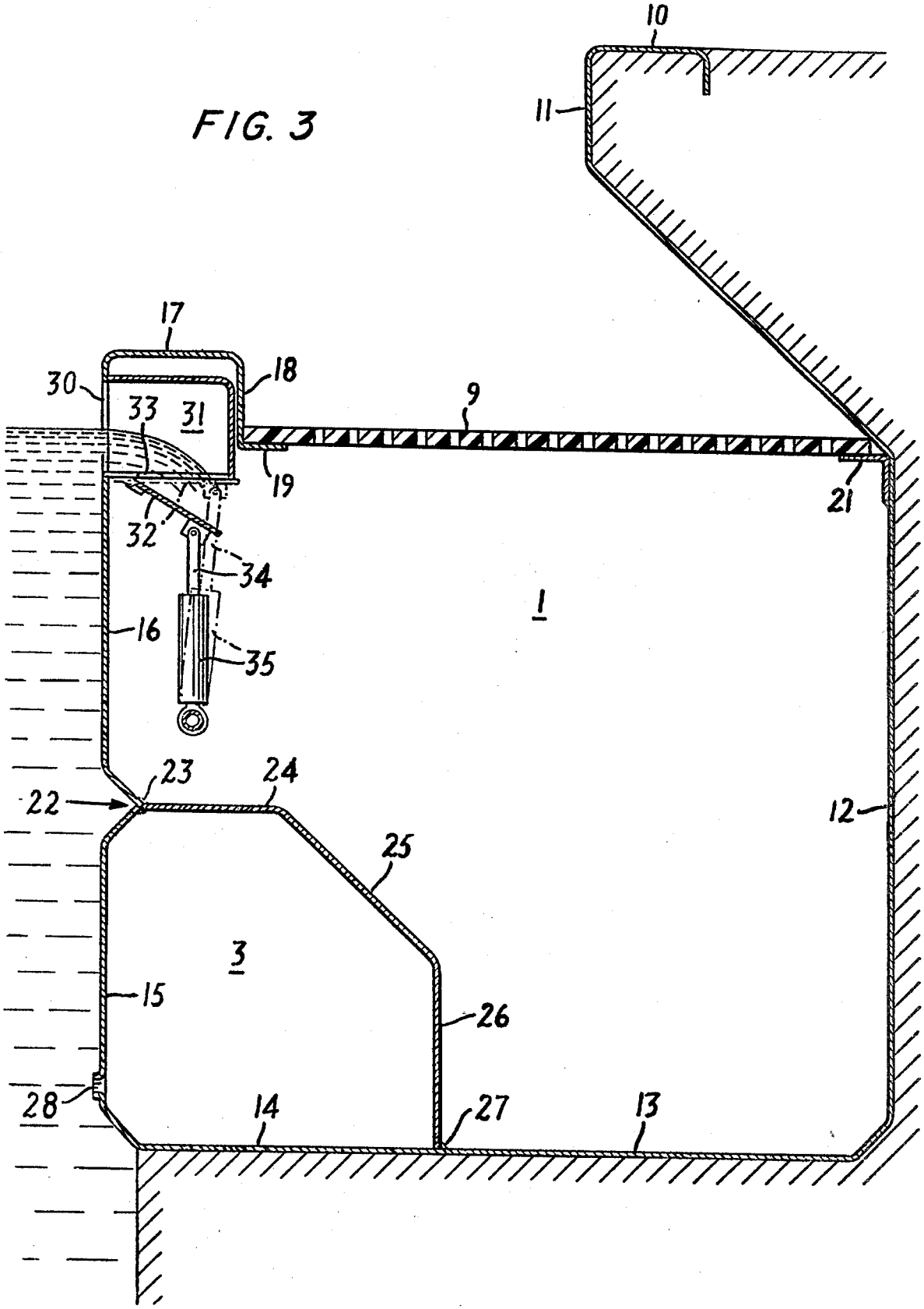
FIG. 3 represents a cross-sectional view through the gutter system shown in FIG. 2, taken along the line 3—3.

The pool perimeter single gutter system shown in FIGS. 1 to 3 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over the opening into the gutter 1, and then continuing to form back wall 12 and the bottom wall 13 of the gutter 1, the bottom wall 14 and pool perimeter side wall 15 of a water feed conduit 3, the pool perimeter side wall 16 of the gutter 1, and the top wall 17 of the gutter 1, which also serves as the top rim of the swimming pool, over which water may flow into the gutter 1. The stainless steel sheet terminates in a flange 19. A second flange 21 is attached by welding or brazing to the back wall 11 of the gutter 1.

A grille 9 rests on flanges 19, 21, and covers over the open top of the gutter 1, so as to prevent bathers from stepping into it, with possibly injurious consequences. The grille is removable and of course can be omitted.

Through the pool perimeter side wall 16 of the gutter are a number of narrow, long openings 30, approximately one-half inch below the top rim 17 of the gutter 1. These openings lead to weir passages 31, which accommodate skimming flow from the pool, and feed it directly into the gutter 1. Surge flow across the top 17 of the perimeter gutter also feeds directly into the gutter 1. Flaps 32 are provided across the openings 33 at the inner ends of the weir passages 31. These flaps on their undersides are pivotally mounted on the pistons 34, which are operated hydraulically in cylinders 35. The flaps can be lowered to the open position, shown in FIGS. 1, 2 and 3, by drawing in the piston, on the suction stroke, or pivoted to the dashed-line position shown in FIG. 3, to close off the weir passages 31, by pushing out the piston, on the power stroke. The opening and closing of the flaps can be effected by any kind of mechanism, however.

The pool perimeter walls 16 of the gutter 1 and 15 of the water feed conduit 3 meet in a V-notch 22. At the base 23 of the V a third sheet of stainless steel is welded, and formed so as to extend inwardly and down to define the other sidewalls 24, 25, 26 of the water feed conduit 3, and is welded to the bottom 13 of the gutter 1 at 27.

A plurality of openings 28 are provided in the pool perimeter wall 15 of the water feed conduit 3, for feed of recirculating clean water to the pool. These openings can, if desired, be provided with nozzles or jets, in known manner, directing flow horizontally or downwardly into the pool.

There is a direct line connection 40 leading from the gutter 1 to the recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter overflow valve 45 in the gutter line 40, so that this can be closed off. Lines 40 and 44 feed into line 56, leading to the pump 54, and serving as a balance line. On the downstream side of the filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculating flow or decreasing it, as may be required. The pump 54 maintains circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location, via line 55.

The water level sensing system 60, best seen in FIG. 1, is composed of two sensors S1, S2 which are single-acting, detecting two different water levels in the gutter 1. These water levels are sensed not in the gutter or pool, but in gutter level chamber 68, directly connected to the gutter 1. The electric sensors S1, S2 and the actuating electric control circuit are well known, conventional and commercially available. In place of electric sensors, pneumatic or pressure-operated sensors can be used, sensing a water pressure related to water level, and actuating an electric control circuit.

The gutter level tank 75 is in fluid flow connection by the line 76 with the gutter 1 at the bottom. In the chamber 68 of this level tank there are arranged the two gutter sensors, S1, S2 each responding to a different level of water in the gutter. The position of these sensors can be adjusted up or down on bracket mounting bar 77, so that any desired two-gutter water levels can be detected, and an appropriate response effected.

The sensor S1 senses and responds to a first level L1 of water in the gutter 1, corresponding to a level of water above the normal operating level N, when the pool is quiescent, with the surge weir passages 31 open, and normal skimming flow provided through the surge weir passages via openings 33 into the gutter. The sensor responds to this level in the gutter by opening the surge weirs, sending an electric signal to the piston 34 and cylinder 35 in the gutter, and actuating the cylinder to withdraw the piston so that the surge weir flaps 32 are opened, in the position shown in FIGS. 1, 2 and 3.

The second gutter sensor S2 senses a second and higher gutter water level L2, corresponding to the increased surge weir flow under light pool activity. When the water level reaches L2, it is because there is too much flow through the weirs, and it is necessary to close the surge weirs, to prevent excessive gutter flow. Sensor S2 responds to this condition by actuating the cylinder and pushing out the piston, closing the flaps 32, and closing off the weirs. In this condition, some surge flow cascades over the top 17 of the perimeter gutter into gutter 1, but gutter 1 has an adequate capacity to accommodate such flow.

Any and all further increases in pool activity will lead to an increased flow of water across the top 17 of the perimeter gutter into the first gutter 1. However, even under maximum pool activity, the flow never fills the gutter 1, which has adequate capacity to accommodate any such increased gutter flow.

It is thus apparent that this sensor system in accordance with the invention senses and responds to a water level in the gutter, so as to close off the weirs, and accommodate the overflow as over-rim flow into the gutter, without gutter flooding or spill back into the pool.

The necessary gutter capacity to accommodate the increased gutter flow during periods of pool activity, whether low or intense, is provided by the gutter, thus ensuring that at no time does water washed into the gutter return to the pool without having first passed through the pool cleansing and recirculation system via the filter. The response to the higher level of activity is fully automatic in all cases.

As pool activity decreases, and gradually returns to normal, the sensors are again actuated in the same order, but in reverse sequence, so that the water recirculation system responds to the now decreased circulation through the gutter.

Thus, a decrease in the gutter level below level L2, down to level L1, leads to the actuation via sensor S1 of the piston arrangement to open the flaps 32, and thus reopen the surge weirs, and this condition is maintained as long as the pool is quiescent, at normal pool operating level, i.e., at gutter level N.

The surge weir control system is consequently fully automatic, whether the flow to be accommodated is increasing or decreasing, and according to whether the pool is quiescent or active.

It will of course be appreciated that different degrees of activity intermediate these can be accommodated, by provision of additional sensors.

Figure 4:
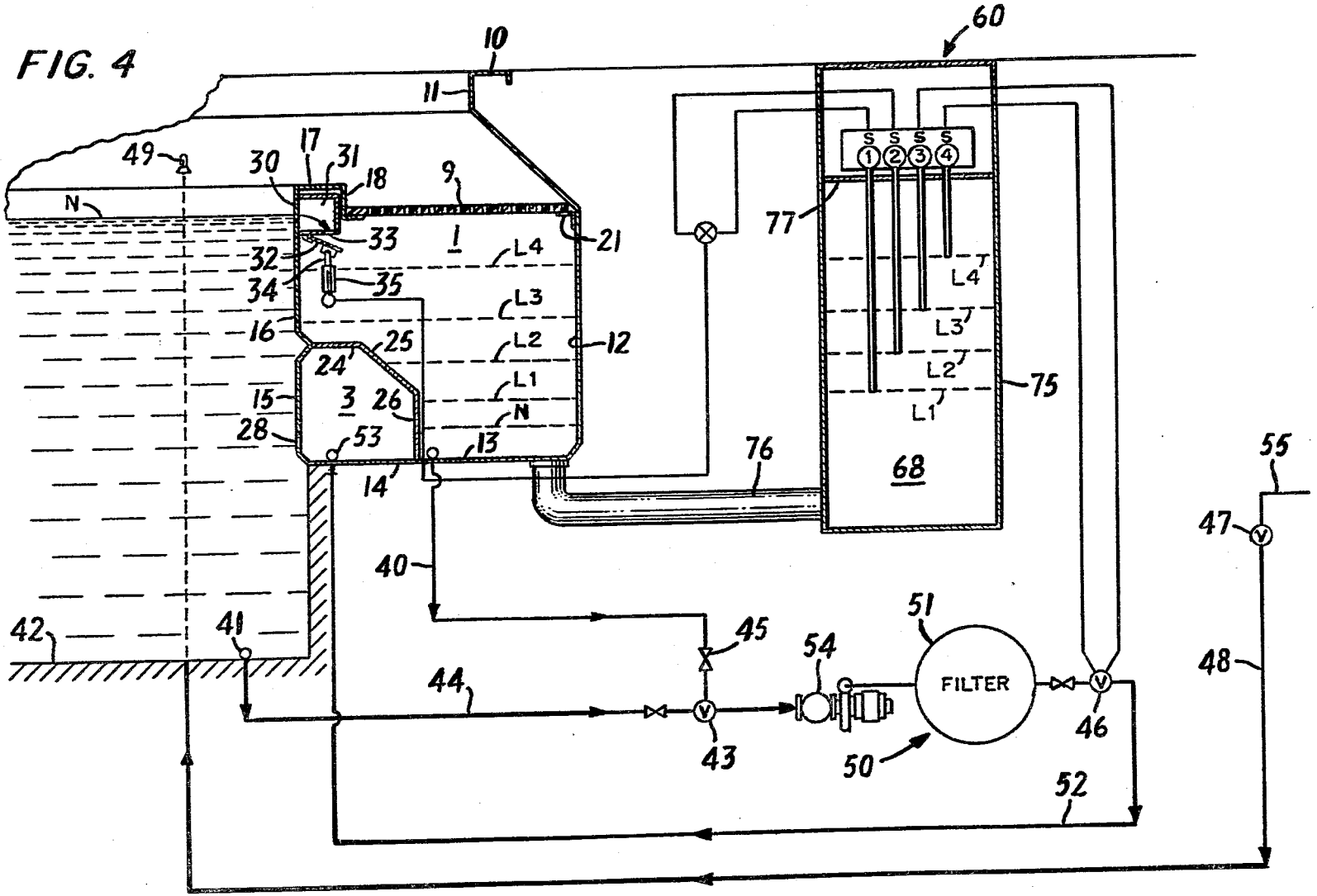
FIG. 4 is a pool water flow circuit diagram, similar to that of FIG. 1, but with two additional sensors for modified intermediate level response.

A modified single-gutter system is shown in FIG. 4, having four single-acting sensors, with two sensors S1 and S2 controlling opening and closing of the surge weirs, and two sensors S3 and S4 controlling the opening and closing of a two-position recirculation flow throttling valve 46, as flow increases or diminishes. In other respects, the system is similar to that of FIG. 1.

The modified gutter water level sensing system 60 of FIG. 4 is composed of four sensors, S1, S2, S3, S4, detecting four different water levels in the gutter 1. These water levels are sensed not in the gutter or pool, but in gutter level chamber 68, directly connected to the gutter 1.

The gutter level tank 75 is in fluid flow connection by the line 76 with the gutter 1 at the bottom. In the chamber 68 of this level tank there are arranged four gutter sensors, S1, S2, S3, S4, responding to four selected different levels of water in the gutter 1. The position of these sensors can be adjusted up or down on bracket mounting bar 77, so that any desired combination of gutter water levels can be detected, and an appropriate response effected.

The first gutter sensor S1 senses and responds to a first level L1 of water in the gutter 1, corresponding to the normal operating level represented by gutter level N, with the pool quiescent, the surge weir passages 31 open, and normal skimming flow provided through the surge weir passages via openings 33 into the gutter. The sensor responds to this level in the gutter by opening the surge weirs, sending an electric signal to the piston 34 and cylinder 35 in the gutter, and actuating the cylinder to withdraw the piston so that the surge weir flaps 32 are opened, in the position shown in FIG. 4.

The second gutter sensor S2 senses a second and higher gutter water level L2, corresponding to the increased surge weir flow under light pool activity. When the water level reaches level L2, there is too much flow through the weirs, and it is necessary to close the surge weirs, to prevent excessive gutter flow. Sensor S2 responds to this condition by actuating the cylinder and pushing out the piston, closing the flaps 32, and closing off the weirs.

In this condition, some surge flow cascades over the top 17 of the perimeter gutter into gutter 1, but gutter 1 has adequate capacity to accommodate such flow.

A further increase in pool activity to the medium activity level will lead to an increased flow of water across the top 17 of the perimeter gutter into the gutter 1. This increases the water level in the gutter, to the level L4, sensed by the fourth gutter sensor S4, and increases the burden on the water recirculation system, which requires adjustment to accommodate the increased gutter flow.

Accordingly, this sensor S4 opens the recirculation flow throttling valve 46, to the next higher open position, further increasing the rate (and therefore the volume amount) of recirculation flow through the recirculation system 50, so as to accommodate the increased flow through the gutter. This is so designed as to accommodate any maximum flow that may be encountered during maximum activity in the pool.

As pool activity decreases, and gradually returns to normal, the third sensor S3 is actuated and thereupon throttles back recirculation flow throttling valve 46, to accommodate normal flow, so that the water recirculation system responds to the now decreased circulation through the gutters.

When the gutter level decreases further, to the level L1, sensor S1 is actuated, and actuates the piston arrangement to open the flaps 32, and thus reopen the surge weirs, and this condition is maintained so long as the pool is quiescent, at normal pool operating level, reflected in gutter level N, thus ensuring adequate skimming flow during periods of quiescence.

Figure 5:
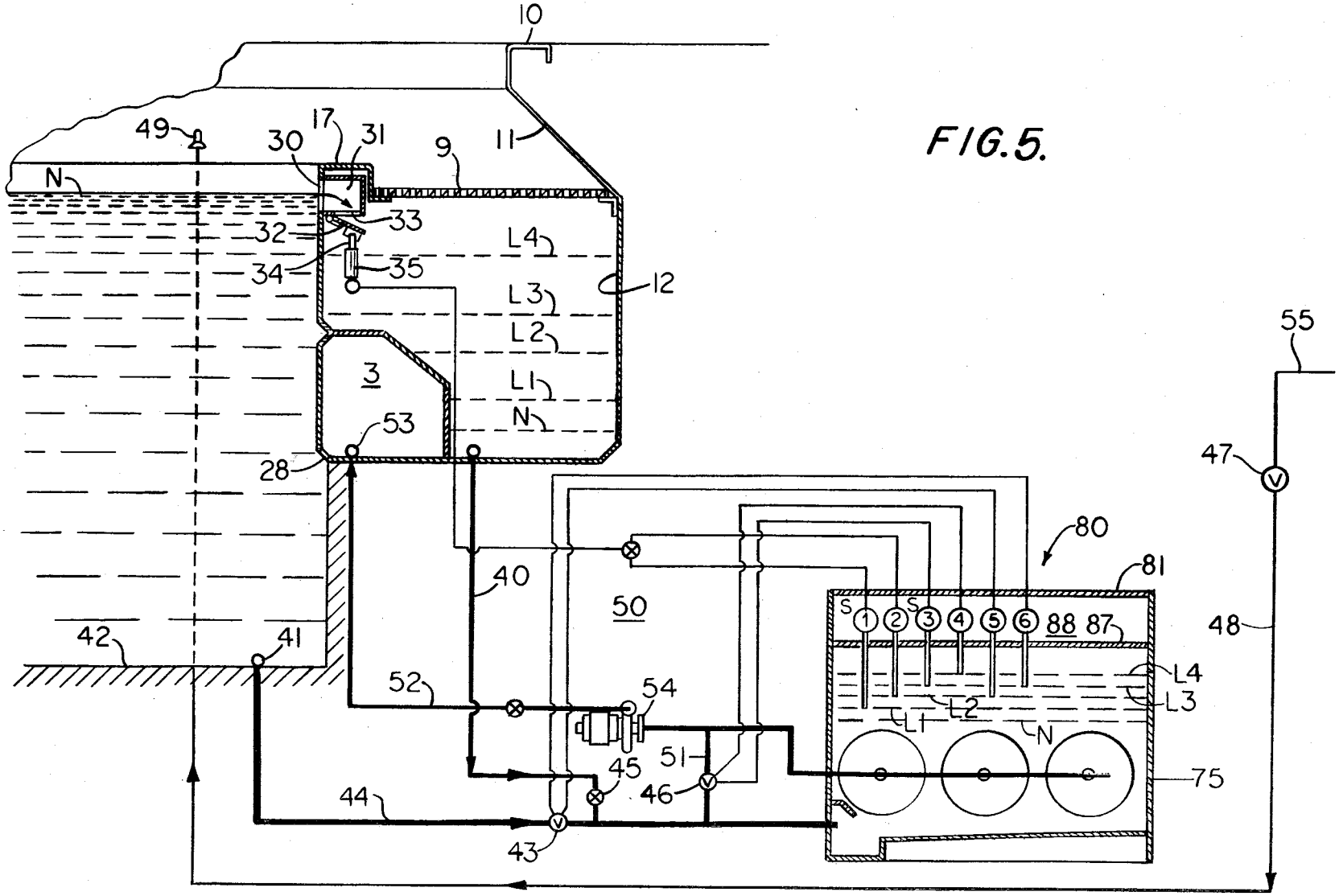
FIG. 5 is a pool water flow circuit diagram similar to that of FIG. 1, but with six sensors in a vacuum filter tank for multiple intermediate level response.

Another modified system is shown in FIG. 5, having six sensors, the two additional sensors S5, S6 controlling the main drain throttling valve 43, the sensors being disposed in a vacuum filter tank. In other respects, the system is similar to that of FIG. 1, FIG. 4, and FIG. 7, and the filter tank is like that of FIG. 6.

The water level sensing system in FIG. 5 is composed of six sensors, S1, S2, S3, S4, S5 and S6 disposed in the vacuum filter tank 75 detecting six different water levels in the vacuum filter tank. These water levels are sensed not in the gutter or pool, but in the vacuum filter tank chamber 88 directly connected to the gutter 1.

The vacuum filter tank 75 is in fluid flow connection by the gutter return line 40 with the gutter 1 at the bottom. In the chamber 88 of the vacuum filter tank, there are arranged six sensors, S1, S2, S3, S4, S5 and S6, each responding to a different level of the water in the filter tank chamber 88. The position of these sensors can be adjusted up or down on bracket mounting bar 87 so that any desired combination of water levels can be detected and an appropriate response effected.

The first gutter sensor S1 senses and responds to the first level L1 of water in the gutter 1, corresponding to the level of water in the gutter above the normal operating level reflected in gutter level N, when the pool is quiescent, with the surge weir passages 31 open, and normal skimming flow provided through the surge weir passages via openings 33 into the gutter. This is reflected in flow to the vacuum filter tank chamber 88 via line 40 and in the level N in the tank. The sensor responds to this level in the tank by opening the surge weirs, sending an electric signal to the piston 34 and cylinder 35 in the gutter, and actuating the cylinder to withdraw so that the surge weir flaps 32 are opened, in the position shown in the Figure.

The second sensor S2 senses a second and higher gutter water level L2, resulting from flow in line 40 corresponding to the increased surge weir flow under light pool activity. When the water reaches L2, there is too much flow through the weirs, and it is necessary to close the surge weirs, to prevent excessive gutter flow. Sensor S2 responds to this condition by actuating the cylinder and pushing out the piston, closing the flaps 32, and closing off the weirs. In this condition, some surge flow cascades over the top 17 of the perimeter gutter into gutter 1, but gutter 1 has adequate capacity to accommodate such flow.

A further increase in pool activity will lead to an increased flow of water across the top 17 of the perimeter gutter into the gutter 1. Under medium pool activity this increases the water flow in the gutter (and in the gutter overflow return line 40) to where the level L3 is reached in chamber 88 of the vacuum filter tank when it actuates sensor S6.

At this level, the flows in the main drain line 44 and the gutter overflow line 40 are at capacity of the water recirculating system 50 so that the increased gutter flow can be accommodated by reducing flow from the main drain line flow from the pool. This is done by sensor S6.

The main drain line 44 is provided with the main drain throttling control valve 43 and the gutter overflow line 40 is provided with the gutter valve 45. Sensor S6 cuts back on the main drive valve 43 to the point where the pump is readily able to accommodate this additional flow coming from gutter overflow line 40 without any increase in the burden on the water recirculating system, and simply draws such flow down from the gutter overflow line 40.

Increased pool activity to the maximum or high activity level further increases the amount of water cascading across the top 17 of the perimeter gutter into gutter 1, with the result that the level in the gutter rises to level L4, sensed by sensor S4. This sensor opens the filter tank bypass valve 46, opening the bypass line 51 and thereby increasing the rate (and therefore the volume amount) of recirculation flow through the recirculation system 50, so as to accommodate the increased flow through the gutter. This is so designed as to accommodate any maximum flow that may be encountered during maximum activity in the pool.

As pool activity decreases, and gradually returns to normal, the two remaining sensors S3,S5 are actuated so that the water recirculation system responds to the now decreased circulation through the gutters.

Thus, a decrease in the gutter level from level L4, sensed by sensor S4, to level L3, is sensed by sensor S3 and results in closing of filter bypass valve 46 and bypass line 51, restoring the normal flow level.

A further decrease in the gutter level from level L3 sensed by sensor S3 to level L2 sensed by sensor S5 causes the sensor S5 to reopen the main drain valve 43 since the pump can now accommodate both pool drain and gutter flow from the gutter overflow line 40.

When the gutter level decreases further below the level L2, actuation by sensor S2 of the piston arrangement opens the flaps 32 and thus reopens the surge weirs.

The gutter level can then drop back to level L1 or below, and this condition is maintained as long as the pool has only light activity or is quiescent with normal pool drain and skimming weir flow reflected in gutter level N.

The pool surge weir and skimming gutter control system of FIGS. 1 to 5 is a water recirculating system which is controlled automatically by the swimming load. The most desirable of the various possible operating modes is selected automatically by the control system, dynamically guided by the amount of people in the pool, and their activity.

In all three systems, during quiescence (no persons in the pool) surface cleaning takes place through open surge weirs. As swimmers enter the pool causing displacement surge and waves, these weirs will automatically and positively close. In the system of FIG. 5, as activity continues to increase, the main drain will close, requiring all water from the swimming pool to be drawn from the perimeter overflow system channels. In the system of FIGS. 4 and 5, as the number of swimmers increases and the activity level increases, the recirculation (turnover) rate will automatically increase, improving the quality of filtration. As the bathers leave the pool, the recirculating rate will return to normal, and the main drain and surge weirs will open at predetermined levels, as the pool returns to its quiescent state. If after reaching quiescence the designed rate of surface cleaning is not being maintained, water can automatically be added to the swimming pool until this rate is achieved.

The system thus responds automatically to user-activated dynamic demand, to determine the operating mode, continuously and automatically for the life of the swimming pool:

1. Sets the proper surface cleaning (skimming) flow rate.
2. Senses whether the surge weirs should be open or closed.
3. Determines whether the main drain should be partially open or closed.
4. Increases the recirculating rate as required due to heavy loading.

In addition to dynamic sensing of the above, this system can be designed to provide surge containment capacity and flow rates for up to 3000 gallons per minute. It offers completely uniform distribution of clean water to the pool; it provides a safety handhold, and it can be supplied with a grating, if this be thought to be desirable.

Due to the increased recirculation rate under heavy loading, the system has the further advantage of improving the pool surface conditions for competition. The higher gutter flow transfer over the perimeter-rim combined with heavier clean water feed has a wave-quelling effect, reducing turbulence. If the clean water feed is directed downwardly, there is created an upflow in the central portion of the pool, drawn off at the perimeter, further reducing wave rebound at the perimeter.

Figure 6:
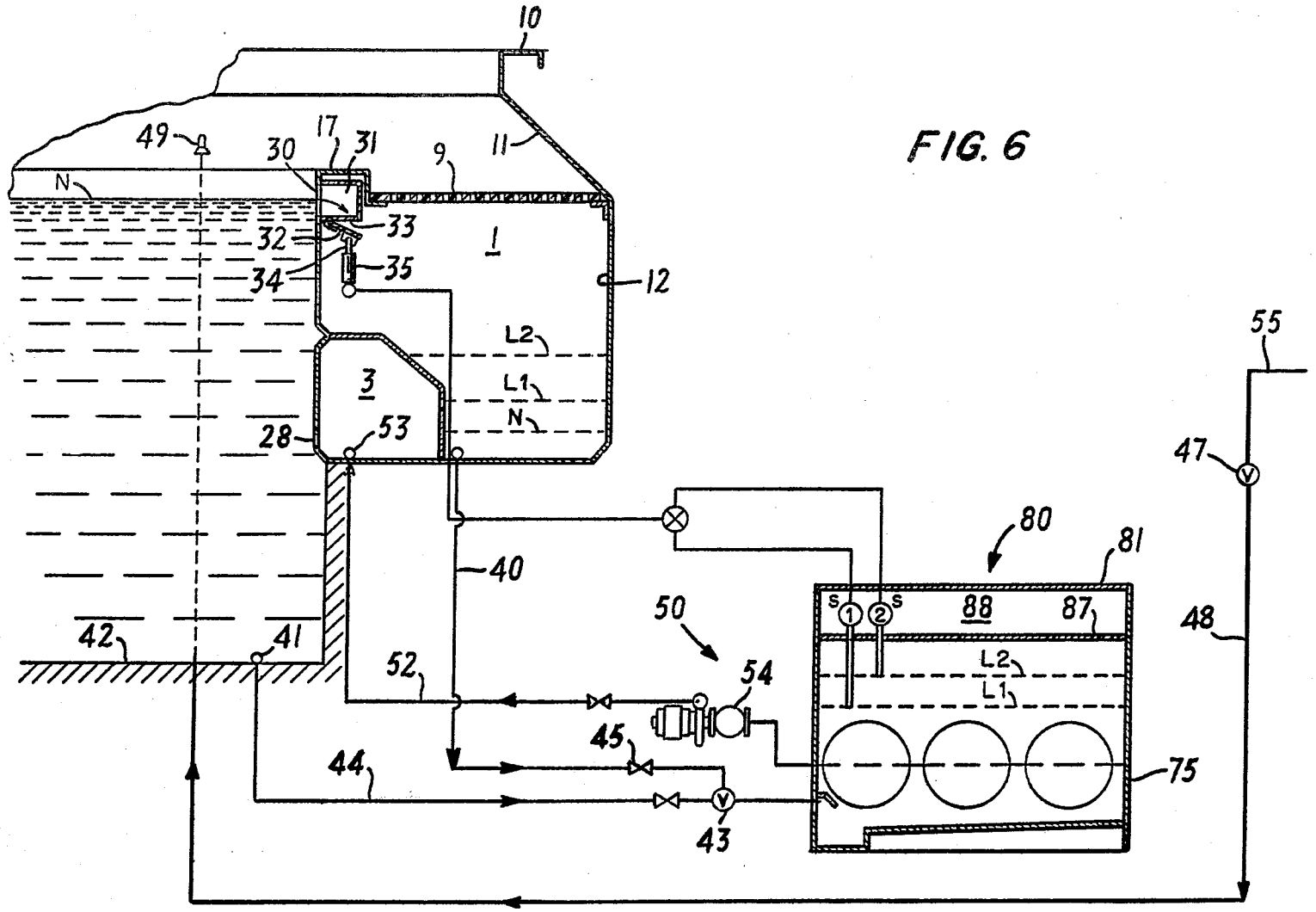
FIG. 6 is a pool water circuit diagram similar to that of FIG. 1, with the sensors in a vacuum filter tank.

The large capacity single-gutter pool perimeter gutter shown in FIG. 6 is similar to that of FIGS. 1 to 3, with the two sensors disposed in the filter tank.

The water level sensing system 80 is composed of two gutter sensors S1, S2, detecting two different water levels in the vacuum filter 81, which is directly connected with the gutter 1 via line 40.

The filter tank 75 is in fluid flow connection by the line 40 with the gutter 1, at the bottom. In the chamber 88 of the filter tank there are arranged the two gutter sensors, S1, S2, each responding to a different level of water in the gutter 1. The position of these sensors can be adjusted up or down on bracket mounting bar 87, so that any desired two gutter water levels can be detected, and an appropriate response effected.

The sensor S1 senses and responds to a first level L1 of water in the tank 81, corresponding to a level of water in the gutter above the normal operating level N, when the pool is quiescent, with the surge weir passages 31 open, and normal skimming flow provided through the surge weir passages via openings 33 into the gutter 1. The sensor responds to this level in the tank 81 by opening the surge weirs, sending an electric signal to the piston 34 and cylinder 35 in the gutter, and actuating the cylinder to withdraw the piston so that the surge weir flaps 32 are opened, in the position shown in FIGS. 1, 2 and 3.

The second gutter sensor S2 senses a second and higher tank water level L2, corresponding to the increased surge weir flow under light pool activity. When the water level reaches L2, it is because there is too much flow through the weirs, and it is necessary to close the surge weirs, to prevent excessive gutter flow. Sensor S2 responds to this condition by actuating the cylinder and pushing out the piston, closing the flaps 32, and closing off the weirs. In this condition, some surge flow cascades over the top 17 of the perimeter gutter into gutter 1, but gutter 1 has adequate capacity to accommodate such flow.

Any and all further increases in pool activity will lead to an increased flow of water across the top 17 of the perimeter gutter into the gutter 1. However, under any maximum pool activity, the flow never fills the gutter 1, which has adequate capacity for any such increased gutter flow.

It is thus apparent that this sensor system in accordance with the invention senses and responds to a selected water level in the tank 81, so as to close off the weirs, and accommodate the overflow as over-rim flow into the gutter, without gutter flooding or spill back into the pool.

The necessary gutter capacity to accommodate the increased gutter flow during periods of pool activity, whether low or intense, is provided by the gutter, thus ensuring that at no time does water washed into the gutter return to the pool without having first passed through the pool cleansing and recirculation system via the filter. The response to the higher level of activity is fully automatic in all cases.

As pool activity decreases, and gradually returns to normal, the sensors are again actuated in the same order, but in reverse sequence, so that the water recirculation system responds to the now decreased circulation through the gutters.

Thus, a decrease in the tank water level below level L2 down to level L1 leads to the actuation via sensor S1 of the piston arrangement to open the flaps 32, and thus reopen the surge weirs, and this condition is maintained as long as the pool is quiescent, at normal pool operating level, i.e., at gutter level N.

Figure 7:
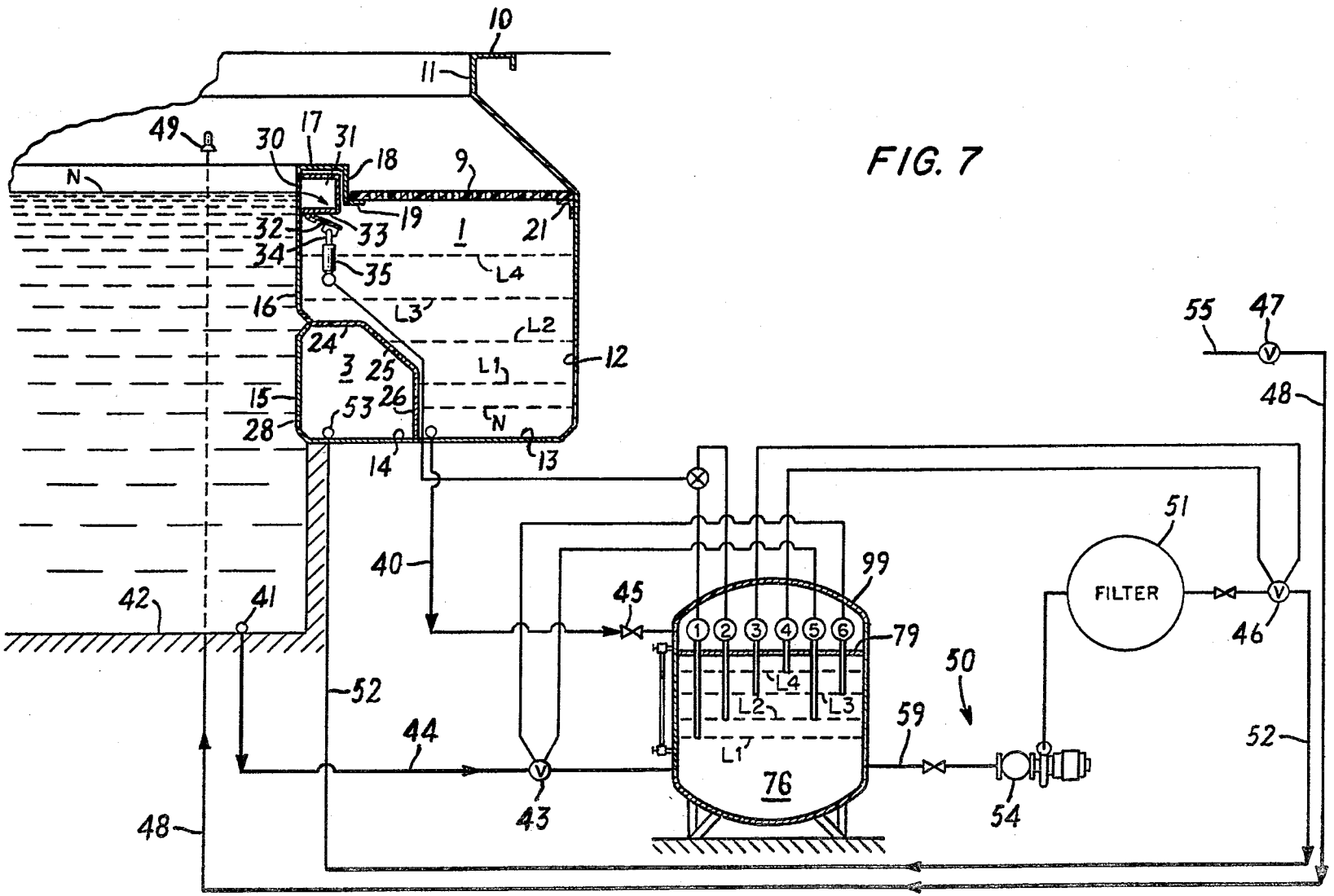
FIG. 7 is a pool water flow circuit diagram of a pool perimeter gutter with six sensors, similar to that of FIG. 5, but disposed in a balance tank.

A further modification of the water flow circulation layout for the pool perimeter gutter system shown in FIG. 5 is shown in FIG. 7. In this case, the gutter level tank 75 is replaced by a balance tank 99 in the gutter overflow line 40.

The direct line connection 40 leading from the gutter 1, leads into the top of the balance tank 99, having a valve 45 so that it can be closed off, and then via line 59 to the recirculation system 50, and there is also a main drain 41 in the bottom 42 of the swimming pool leading via main drain line 44 to the bottom of tank 99. There is a main drain throttling valve 43 in the main drain line 44, so that this line can be closed off, or partially or fully opened. On the downstream side of filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculation flow or decreasing it, as may be required. The pump 54 maintains circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location.

The water level sensing system of FIG. 7 is disposed in the balance tank 99, and is composed of six sensors S1, S2, S3, S4, S5 and S6, detecting four different water levels in the balance tank. The balance tank water level is directly correlated with water flow in the gutter 1.

In the chamber 78 of the balance tank 99 there are arranged the six sensors, S1, S2, S3, S4, S5 and S6, responding to four different levels of water in the tank. The position of these sensors can also be adjusted up or down on bracket mounting bar 79, so that any desired combination of water levels can be detected, and an appropriate response effected.

The first sensor S1 senses and responds to a first level L1 of water in tank 99 above the normal operating gutter water level, reflected in gutter level N, with the pool quiescent, with the surge weir passages 31 open, and normal skimming flow provided through the surge weir passages via openings 33 into the gutter. The sensor responds to this level in the tank 99 by opening the surge weirs, sending an electric signal to the piston 34 and cylinder 35 in the gutter, and actuating the cylinder to withdraw the piston, so that the surge weir flaps 32 are opened, in the position shown in the Figure.

The second sensor S2 senses a second and higher water level L2 in the tank 99, corresponding to the increased surge weir flow into the gutter under light pool activity. When the water level reaches L2, there is too much flow through the weirs, and it is necessary to close the surge weirs, to prevent excessive gutter flow. Sensor S2 responds to this condition by actuating the cylinder and pushing out the piston, closing the flaps 32, and closing off the weirs. In this condition, some surge flow cascades over the top 17 of the perimeter gutter into gutter 1, but gutter 1 has adequate capacity to accommodate such flow.

A further increase in pool activity will lead to an increased flow of water across the top 17 of the perimeter gutter into the first gutter 1. This increases the water flow in the gutter, and in the gutter overflow return line 40, bringing the water level in the balance tank 99 to the level L3, sensed by the gutter sensor S6, and increases the burden on the water recirculation system, which requires adjustment to accommodate the increased gutter flow.

Accordingly, this sensor S6 is in actuating connection with the main drain throttling valve 43, and closes the main drain valve, thus making it possible for the recirculation system 50 to accommodate the increased gutter overflow in line 40, the flow through which is now equal to that formerly reaching the balance tank 99 and recirculation system 50 from the combined volumes of the flows in the main drain line 44 and gutter overflow line 40.

Increased pool activity to the maximum activity level further increases the amount of water cascading across the top 17 of the perimeter gutter into gutter 1, with the result that the level in tank 99 rises to level L4 sensed by the fourth sensor S4. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

As pool activity decreases, and gradually returns to normal, sensors S5 and S3 are actuated, so that the water recirculation system responds to the now decreased circulation through the gutters.

Thus, a decrease in the water level below level L4 to level L3, sensed by sensor S3, results in a throttling back of recirculation flow throttling valve 46. When the level decreases further, to level L2, sensor S5 again opens the main drain throttling valve 43. Further decrease to level L1 leads to the actuation via sensor S1 of the piston arrangement to open the flaps 32 and thus reopen the surge weirs, and this condition is maintained as long as the pool is quiescent, at normal pool operating level.

The balance tank control system of FIG. 7, like that of FIG. 5, is a water recirculating system which is controlled automatically by the swimming load. The most desirable of the various possible operating modes is selected automatically by the control system, dynamically guided by the amount of people in the pool, and their activity.

During quiescence (no persons in the pool) surface cleaning takes place through open surge weirs. As swimmers enter the pool causing displacement surge and waves, these weirs will automatically and positively close. As activity continues to increase, the main drain will close requiring all water from the swimming pool to be drawn from the perimeter overflow system channels. As the number of swimmers increases and the activity level increases, the recirculation (turnover) rate will automatically increase, improving the quality of filtration. As the bathers leave the pool, the recirculating rate will return to normal, and the main drain and surge weirs will open at predetermined levels, as the pool returns to its quiescent state. If after reaching quiescence the designed rate of surface cleaning is not being maintained, water will automatically be added to the swimming pool until this rate is achieved.

Figure 8:
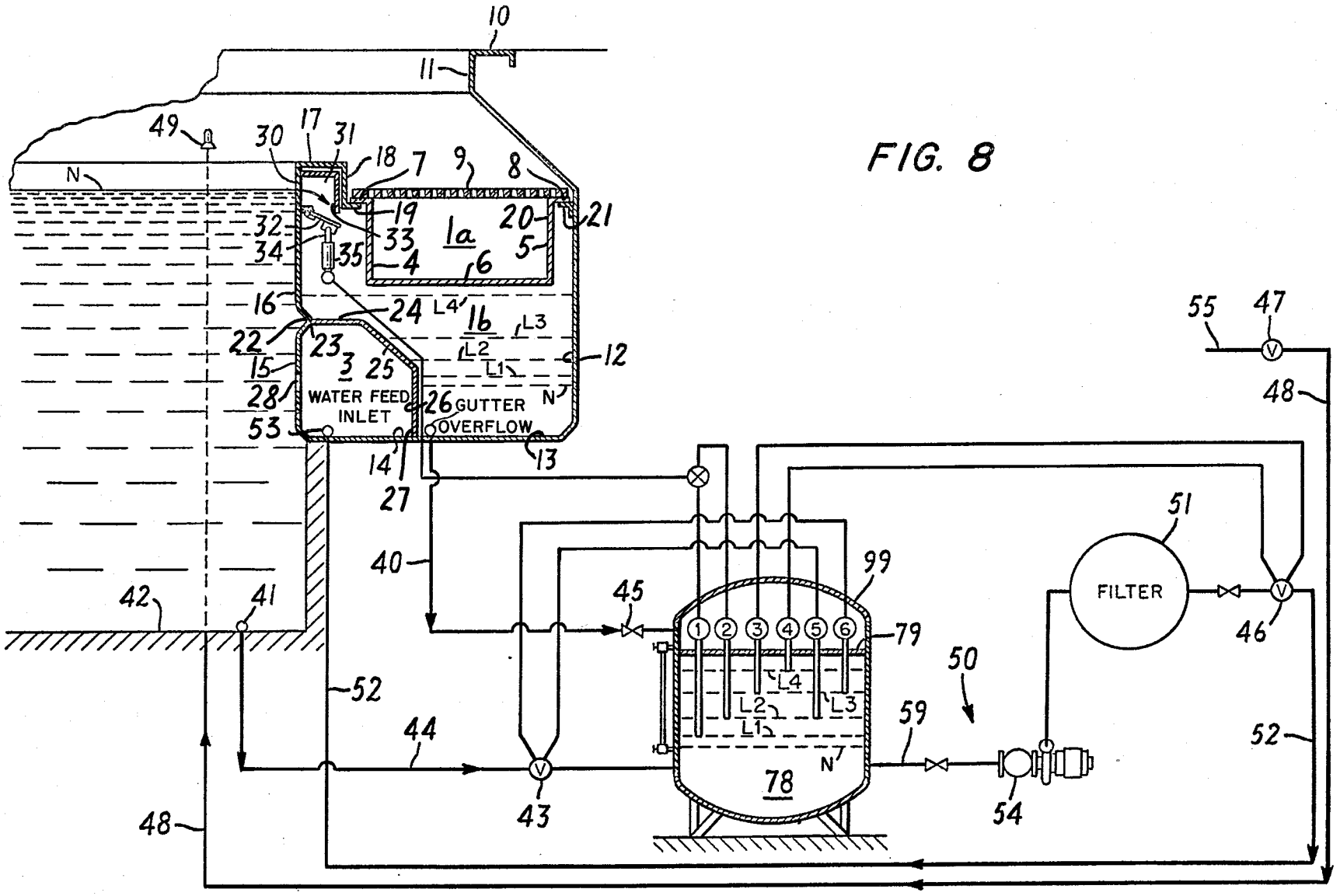
FIG. 8 is a pool water flow circuit diagram of a pool perimeter gutter with two gutters and six sensors, similar to that of FIG. 7, and disposed in a balance tank.

A further modification of the water flow circulation layout shown in FIG. 7 for a two-gutter pool perimeter gutter system is shown in FIG. 8. In this case, the single gutter 1 is replaced by two gutters, 1*a*, and 1*b*.

The pool perimeter gutter shown in FIG. 8 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over a first gutter 1*a*, and then continuing to form the back wall 12 and bottom wall 13 of a second gutter 1*b*, the bottom wall 14 and pool perimeter side wall 15 of a water feed conduit 3, the pool perimeter side wall 16 of the second gutter 1*b*, and the top wall 17 of the second gutter 1*b*, which also serves as the top rim of the swimming pool, over which water may flow into the first gutter 1*a*. The stainless steel sheet terminates in a flange 19, which serves as a ledge support for one side of the first gutter 1*a*. A second flange 21 is attached by welding or brazing to the back wall 12 of the second gutter 1*b* to serve as the other ledge support for the first gutter 1*a*.

The first gutter 1*a* is made of another sheet of stainless steel, formed in a U-configuration, with sides 4,5, and bottom 6, terminating in flanges 7,8 supporting the gutter on flanges 19,21 of the first sheet. A grille 9 rests on flanges 7,8, and covers over the open top of the first gutter, so as to prevent bathers from stepping into it, with possibly injurious consequences. The grille of course can be omitted.

In the side wall 5 of the first gutter, there is one or several openings 20 in the form of long narrow slots providing fluid flow communication with the second gutter 1*b* at the top of the gutter 1*a*. These openings define the maximum water level in the first gutter, since water above this level automatically flows through the openings 20 into the second gutter. The openings are sufficiently numerous and large to accommodate such flow, thus preventing flooding of the first gutter.

Through the pool perimeter side wall 16 of the second gutter 1*b* are a number of narrow, long openings 30, approximately one-half inch below the top of the top of the gutter. These openings lead to weir passages 31, which accommodate skimming flow from the pool, and feed directly into the second gutter 1*b*. Thus, skimming flow is separated from surge flow across the top 17 of the perimeter gutter, which feeds directly into the first gutter 1*a*. Flaps 32 are provided across the openings 33 at the inner ends of the passages. These flaps on their undersides are pivotally mounted on the pistons 34, which are operated hydraulically in cylinders 35. The flaps can be lowered to the open position, shown in FIG. 8, by drawing in the piston, on the suction stroke, or pivoted to the closed position (not shown in FIG. 8) to close off the weir passages 31, by pushing out the piston, on the power stroke. The opening and closing of the flaps can be effected by any kind of mechanism, however.

The pool perimeter walls 16 of the second gutter 1*b* and 15 of the water feed conduit 3 meet in a V-notch 22. At the base 23 of the V a third sheet is welded, and formed so as to extend inwardly and down to define the other sidewalls 24, 25, 26 of the water feed conduit 3, and is welded to the bottom 13 of the second gutter conduit 1*b* at 27.

A plurality of openings 28 are provided in the pool perimeter wall 15 of the water feed conduit 3, for feed of recirculating clean water to the pool. These openings can, if desired, be provided with nozzles or jets, in known manner, directing flow horizontally or downwardly into the pool.

In other respects, the system is similar to that of FIG. 7. The direct line connection 40 leading from the second gutter 1*b* leads into the top of the balance tank 99, having a valve 45 so that it can be closed off, and then via line 59 to the recirculation system 50, and there is also a main drain 41 in the bottom 42 of the swimming pool leading via main drain line 44 to the bottom of tank 99. There is a main drain throttling valve 43 in the main drain line 44, so that this line can be closed off, or partially or fully opened. On the downstream side of filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculation flow or decreasing it, as may be required. The pump 54 maintains circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location.

The water level sensing system of FIG. 8 is disposed in the balance tank 99, and is composed of six sensors S1, S2, S3, S4, S5, and S6, detecting four different water levels in the balance tank. The balance tank water level is directly correlated with water flow in the second gutter 1*b*.

In the chamber 78 of the balance tank 99 there are arranged the six sensors S1, S2, S3, S4, S5 and S6, responding to four different levels of water in the tank. The position of these sensors can also be adjusted up or down on bracket mounting bar 79, so that any desired combination of water levels can be detected, and an appropriate response effected.

The first sensor S1 senses and responds to a first level L1 of water in tank 99 above the normal operating second gutter water level, reflected in gutter level N, with the pool quiescent, with the surge weir passages 31 open, and normal skimming flow provided through the surge weir passages via openings 33 into the second gutter 1*b*. The sensor responds to this level in the tank 99 by opening the surge weirs, sending an electric signal to the piston 34 and cylinder 35 in the gutter, and actuating the cylinder to withdraw the piston, so that the surge weir flaps 32 are opened, in the position shown in the Figure.

The second sensor S2 senses a second and higher water level L2 in the tank 99, corresponding to the increased surge weir flow into the second gutter under light pool activity. When the water level reaches L2, there is too much flow through the weirs, and it is necessary to close the surge weirs to prevent excessive gutter flow. Sensor S2 responds to this condition by actuating the cylinder and pushing out the piston, closing the flaps 32, and closing off the weirs. In this condition, some surge flow cascades over the top 17 of the perimeter gutter into gutter 1*a* but gutter 1*a* has adequate capacity to accommodate such flow.

A further increase in pool activity will lead to an increased flow of water across the top 17 of the pool perimeter into the first gutter 1*a*. This increases the water flow in the gutter 1*a*, which spills over via the slots 20 into the second gutter 1*b*, and thus in the gutter overflow return line 40, bringing the water level in the balance tank 99 to the level L3, sensed by the gutter sensor S6, and increases the burden on the water recirculation system, which requires adjustment to accommodate the increased gutter flow.

Accordingly, this sensor S6 is in actuating connection with the main drain throttling valve 43, and closes the main drain valve, thus making it possible for the recirculation system 50 to accommodate the increased gutter overflow in line 40, the flow through which is now equal to that formerly reaching the balance tank 99 and recirculation system 50 from the combined volumes of the flows in the main drain line 44 and gutter overflow line 40.

Increased pool activity to the maximum activity level further increases the amount of water cascading across the top 17 of the pool perimeter into gutter 1*a* and then into gutter 1*b*, with the result that the level in tank 99 rises to level L4, sensed by the fourth sensor S4. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

As pool activity decreases, and gradually returns to normal, sensors S5 and S3 are actuated, so that the water recirculation system responds to the now decreased circulation through the gutters.

Thus, a decrease in the water level below level L4 to level L3, sensed by sensor S3, results in a throttling back of recirculation flow throttling valve 46. When the level decreases further, to level L2, sensor S5 again opens the main drain throttling valve 43. Further decrease to level L1 leads to the actuation via sensor S1 of the piston arrangement to open the flaps 32 and thus reopen the surge weirs, and this condition is maintained as long as the pool is quiescent, at normal pool operating level.

The balance tank control system of FIG. 8, like that of FIG. 7, is a water recirculating system which is controlled automatically by the swimming load. The most desirable of the various possible operating modes is selected automatically by the control system, dynamically guided by the amount of people in the pool, and their activity.

During quiescence (no person in the pool) surface cleaning takes place through open surge weirs. As swimmers enter the pool causing displacement surge and waves, these weirs will automatically and positively close. As activity continues to increase, the main drain will close requiring all water from the swimming pool to be drawn from the perimeter overflow system channels. As the number of swimmers increases and the activity level increases, the recirculation (turnover) rate will automatically increase, improving the quality of filtration. As the bathers leave the pool, the recirculating rate will return to normal, and the main drain and surge weirs will open at predetermined levels, as the pool returns to its quiescent state. If after reaching quiescence the designed rate of surface cleaning is not being maintained, water will automatically be added to the swimming pool until this rate is achieved.

The system thus responds automatically to user-activated dynamic demand, to determine the operating mode, continuously and automatically for the life of the swimming pool.

The water flow control system is consequently fully automatic, whether the flow to be accommodated is increasing or decreasing, and according to whether the activity in the pool is nil (quiescent), light, medium or heavy.

The perimeter gutters and weirs shown in FIGS. 1 to 7 are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter and/or the weir of plastic material, either in whole or in part. There are plastics now available which are sufficiently strong to withstand the wear and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter.

The use of modular units such as are shown in FIGS. 1 to 7 is preferred, because this permits mass production of the gutter and weir system at a point remote from the swimming pool, with easy and inexpensive transportion from that point to swimming pool construction sites anywhere in the world. The modular units can then be assembled on-site to form any type or configuration of swimming pool, and any desired weir arrangement. The modular units can be made in straight sections for rectangular or other straight-sided pool shapes, while curved sections can be made for pear-shaped, elliptical, circular, or other curved-side pool configurations.

The modular units can be fitted together by welding, soldering or brazing, in the case of metal units; by bonding, using various types of adhesives, in the case of metal or plastic units; or by heat-sealing, ultrasonic welding, or heat-bonding, in the case of thermoplastic plastic units. Plastic units which are not fully heat-cured can be bonded and then cured in situ to form a permanent bond on site, in the correct of construction of the pool.

The perimeter gutter and weir system of the invention can be used completely around the perimeter of a pool, or only partially around the pool perimeter, as desired. The most uniform skimming action and gutter action is, of course, obtained when the entire perimeter of the pool is provided with such a gutter and weir.

While construction of the gutter and weir in the form of modular units has been described, it will also be appreciated from FIGS. 1 to 7 that the gutter and weir system can be formed on-site in the configurations shown using concrete or plastic material, and can form an integral part of the pool wall, by casting or pouring into suitable frames, so that the material can harden and set in the desired pool and skimmer outlet shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a handmade gutter system on the pool site.

The gutter and weir system can also be made from bricks or tiles, which are built up in the desired configuration. These can be the usual types of materials, preferably with a ceramic facing, so that it is leak-proof, with the tiles being bonded together with water-resistance adhesive or cement.

recirculation system for water feed from the pool for cleaning; a drain valve in the first drain line which when open allows water from the pool to flow to the water recirculation system and when closed stops such flow; a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; a second drain line connecting the gutter conduit with the water recirculation system for water feed from the gutter for cleaning; at least one surge weir having a weir closure movable between open and closed positions and disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a balance means in flow connection with the first and second drain lines and the water recirculation system receiving pool water via each drain line, blending the pool waters, and flowing the blended waters to the water recirculation system; a first sensor sensing a first water level in the balance means characteristic of a low threshhold of pool activity but excessive weir skimming flow, and arranged to close at least one weir closure; and a second sensor sensing a second higher level in the balance means characteristic of a high degree of water flow, wave action and surges into the first gutter conduit, and closing the drain valve and thereby increasing water recirculation system capacity to recirculate such increased gutter flow and prevent wash-back from a gutter conduit to the pool.

53. A twin-gutter automated pool perimeter skimming gutter control system comprising, in combination, a water cleaning and recirculation system receiving water from the pool, cleaning it, and returning it to the pool; a first drain line connecting the pool to the water recirculation system for water feed from the pool for cleaning; a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; a second drain line connecting the gutter conduit with the water recirculation system for water feed from the gutter for cleaning; at least one surge weir having a weir closure movable between open and closed positions and disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water recirculation throttling valve controlling the capacity for recirculating water flow of water cleaning and recirculating system; a balance means in flow connection with the first and second drain lines and the water recirculation system receiving pool water via each drain line, blending the pool waters, and flowing the blended waters to the water recirculation system; a first sensor sensing a first water level in the balance means characteristic of a low threshhold of pool activity but excessive weir skimming flow, and closing at least one weir closure; and a second sensor sensing a second higher level in the balance means characteristic of a high degree of water flow, wave action and surges into the first gutter conduit, and adjusting the water recirculation throttling valve to increase water recirculation system capacity to recirculate such increased gutter flow and prevent wash-back from a gutter conduit to the pool.

54. An automated perimeter skimming gutter control system comprising, in combination, a water cleaning and recirculation system receiving water from the pool, cleaning it, and returning it to the pool; a first drain line connecting the pool to the water recirculation system for water feed from the pool for cleaning; a drain valve in the first drain line which when open allows water from the pool to flow to the water recirculation system and when closed stops such flow; a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; a second drain line connecting the gutter conduit with the water recirculation system for water feed from the gutter for cleaning; at least one surge weir having a weir closure movable between open and closed positions and disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water recirculation throttling valve controlling the capacity for recirculating water flow of the water cleaning and recirculating system; a balance means in flow connection with the first and second drain lines and the water recirculation system receiving pool water via each drain line, blending the pool waters, and flowing the blended waters to the water recirculation system; a first sensor sensing a first water level in the balance means characteristic of a low threshhold of pool activity but excessive weir skimming flow, and closing at least one weir closure; a second sensor sensing a second higher level in the balance means characteristic of a high degree of water flow, wave action and surges into the gutter conduit, and closing the first drain valve, thereby increasing water recirculation system capacity to recirculate such increased gutter flow; and a third sensor sensing a third higher level in the balance means characteristic of a higher degree of water flow, wave action and surges into the gutter conduit; and adjusting the water recirculation throttling valve to increase recirculation system capacity to accommodate such increased overflow, and prevent wash-back from the gutter conduit to the pool.

55. A twin-gutter automated pool perimeter skimming gutter control system comprising, in combination, a water cleaning and recirculation system receiving water from the pool, cleaning it, and returning it to the pool; a first drain line connecting the pool to the water recirculation system for water feed from the pool for cleaning; a drain valve in the first drain line which when open allows water from the pool to flow to the water recirculation system and when closed stops such flow; a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; a second drain line connecting the gutter conduit with the water recirculation system for water feed from the gutter for cleaning; at least one surge weir having a weir closure movable between open and closed positions and disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water recirculation throttling valve controlling the capacity for recirculating water flow of the water cleaning and recirculating system; a balance means in flow connection with the first and second drain lines and the water recirculation sytem receiving pool water via each drain line, blending the pool waters, and flowing the blended waters to the water recirculation system; a first sensor sensing a higher water level in the balance means characteristic of a low threshhold of pool activity, but excessive weir skimming flow, and closing at least one weir closure; a second sensor sensing a higher level in the balance means characteristic of a high degree of water flow, wave action and surges into the first gutter conduit, and closing the first drain valve, thereby increasing water recirculation system capacity to recirculate such increased gutter flow to the pool; and a third sensor sensing a higher level in the balance means characteristic of a higher degree of water flow, wave action and surges into the conduit, and adjusting the water recirculation throttling valve to increase recirculation system capacity to accommodate such increased gutter flow, and prevent wash-back from a gutter conduit to the pool.

* * * * * senses a higher water level in the balance means in the second gutter, and closes the drain valve, thereby increasing water recirculation capacity for gutter flow at such higher water level.

26. A swimming pool comprising side walls and a bottom adapted to retain water therewithin, and, extending about the upper perimeter of at least a portion of one side wall thereof, a perimeter skimming gutter comprising, in combination, a water cleaning and recirculation system receiving water from the pool, cleaning it, and returning it to the pool; a first drain line connecting the pool to the water recirculation system for water feed from the pool for cleaning; a gutter conduit disposed about the perimeter of the swimming pool, receiving overflow across a top edge thereof and adapted to carry water at a level below a predetermined level in the swimming pool; a second drain line connecting the gutter conduit with the water recirculation system for water feed from the gutter for cleaning; skimming means receiving skimming flow across a top edge thereof at the perimeter of the swimming pool; a first drain valve in the first drain line which when open allows water from the pool to flow to the water recirculation system, and when closed stops such flow; a balance means in flow connection with the first and second drain lines and the water recirculation system, receiving pool water via each drain line, blending the pool waters, and flowing the blended waters to the water recirculation system; and at least one water level-responsive sensor sensing and directly responding to the level of water in the balance means and adjusting the water recirculation flow from the pool and from the gutter to increase water recirculation system capacity for flow from the gutter and prevent gutter water flooding back from the gutter to the pool.

27. A swimming pool in accordance with claim 26 in which the perimeter skimming gutter comprises a second gutter receiving skimming flow and also providing additional gutter capacity for extraordinary gutter flow, including relief flow from the first gutter in the event of considerable activity in the pool.

28. A swimming pool in accordance with claim 26 wherein the balance means is a balance tank.

29. A swimming pool in accordance with claim 26 wherein the balance means is a vacuum filter.

30. A swimming pool in accordance with claim 26 wherein the skimming means comprises a closure member movable between open and closed positions; the sensor senses a predetermined water level in the balance means at which skimming flow corresponds to a greater-than-normal skimming flow, and moves the closure into a closed position, arresting skimming flow and retaining water in the pool, but allowing flow surges to proceed into the gutter.

31. A swimming pool in accordance with claim 30, wherein the skimming means comprises at least one surge weir in a pool perimeter wall, and the closure closes the surge weir.

32. A swimming pool in accordance with claim 26, wherein the sensor senses a predetermined water level in the balance means at which overflow exceeds normal recirculation flow combined from the first and second lines and closes the first drain valve so that the recirculation system receives only pool water flowing from the gutter.

33. A swimming pool in accordance with claim 26, wherein the water recirculation system includes a recirculating flow throttling valve, movable between open and closed positions and controlling recirculating flow to and from the pool; and the sensor senses a predetermined water level in the balance means at which the capacity of the recirculation system is exceeded, and adjusts the throttling valve, increasing the amount of water drawn through the recirculation system to accommodate this excess flow.

34. A swimming pool in accordance with claim 26, wherein the water recirculating system includes a filter and a line bypassing the filter, and a bypass valve movable between open and closed positions, controlling flow through the bypass line; and the sensor opens the bypass valve, thereby opening the line bypassing the filter.

35. A swimming pool in accordance with claim 26, comprising a recirculating flow throttling control valve on the return line of the recirculation system; a first sensor that senses a predetermined water level in the balance means at which overflow exceeds normal recirculation flow combined from drains, and closes the first drain valve, so that the recirculation system receives only pool water flowing from the gutter; and a second sensor that senses a predetermined water level in the balance means at which the capacity of the recirculation system is exceeded, and adjusts the throttling valve to increase the amount of water drawn through the recirculation system, to accommodate this excess flow.

36. A swimming pool in accordance with claim 26, wherein the skimming means comprises a closure member movable between open and closed positions; the water recirculation system includes a recirculating flow throttling valve, movable between open and closed positions and controlling recirculating flow to and from the pool; and comprising a first sensor that senses a predetermined water level in the balance means at which skimming flow corresponds to a greater-than-normal skimming flow, and closes the closure, arresting skimming flow and retaining water in the pool, but allowing flow surges to proceed into the gutter; a second sensor that senses a predetermined water level in the balance means at which flow exceeds normal recirculation flow combined from the first and second drains and closes the first drain valve so that the recirculation system receives only pool water flowing from the gutter; and a third sensor that senses a predetermined water level in the balance means at which the capacity of the recirculation system is exceeded, and adjusts the throttling control valve to increase the amount of water drawn through the recirculation system, to accommodate this excess flow.

37. A swimming pool in accordance with claim 26, comprising, in combination, a second gutter conduit for disposition about the perimeter of a swimming pool, and adapted to carry water at a level below a predetermined level of water in the swimming pool; a retaining wall on the pool side of the gutter conduit, over the top of which wall water may flow from the pool into the first gutter conduit; the top of the wall being placed at a height to maintain a predetermined water level in the pool, to provide a skimming flow of water at such predetermined water level in the pool, and to allow excessive flows, wave actions and surges to flow over the top of the wall into the first gutter conduit; and a third drain line connecting the first and second gutters with the water cleaning and recirculating system for water feed from the first and second gutter conduits, for cleaning.

38. A swimming pool in accordance with claim 37, in which the first gutter conduit is an open trough.

39. A swimming pool in accordance with claim 37, having a fluid flow connection between the first and second gutter conduits in the form of a plurality of slots at the predetermined maximum level of water in the first gutter conduit.

40. A swimming pool in accordance with claim 37, in which the two gutter conduits are separated by a common wall, and the fluid flow connection between the two gutters is provided by a plurality of openings through the wall.

41. A swimming pool in accordance with claim 37, comprising at least one jet water-feed inlet in either the first or the second gutter conduit, or both, for driving water and debris along the gutter conduit.

42. A swimming pool in accordance with claim 37, in the form of a modular wall unit adapted to be assembled end-to-end with other such units to form the perimeter gutter wall of a swimming pool.

43. A swimming pool in accordance with claim 37, in which the second gutter is within the pool side retaining wall of the first gutter conduit.

44. A swimming pool in accordance with claim 37, in which the second gutter is within an external peripheral wall of the first gutter conduit.

45. A swimming pool in accordance with claim 37, in which a water-feed conduit is provided for feed of fresh water into the pool.

46. A swimming pool in accordance with claim 45, in which the water-feed conduit is disposed beside the first gutter conduit.

47. A swimming pool in accordance with claim 45, in which the water-feed conduit is disposed within the first gutter conduit.

48. A swimming pool in accordance with claim 45, in which the water-feed conduit is disposed within the second gutter conduit.

49. A swimming pool comprising side walls and a bottom adapted to retain water therwithin, and extending about the upper perimeter of at least a portion of one side wall thereof, a perimeter skimming gutter comprising in combination, a water cleaning and recirculation system receiving water from the pool, cleaning it, and returning it to the pool; a first drain line connecting the pool to the water recirculation system for water feed from the pool for cleaning; a first gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; a second gutter conduit in fluid flow communication with the first gutter conduit at a predetermined maximum water level in the first gutter conduit, and adapted to carry water at a level below a predetermined level of water in the swimming pool and in the first gutter conduit; a second drain line connecting the gutter conduit with the water recirculation system for water feed from the gutter for cleaning; at least one surge weir having a weir closure movable between open and closed positions and disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a balance means in flow connection with the first and second drain lines and the water recirculation system receiving pool water via each drain line, blending the pool waters, and flowing the blended waters to the water recirculation system; and a sensor sensing a water level in the balance means corresponding to pool activity inducing excessive weir skimming flow, and closing at least one weir closure, thereby to decrease gutter flow, and prevent exceeding water recirculation system capacity and wash-back from a gutter conduit to the pool.

50. A swimming pool in accordance with claim 49 having a drain valve in the first drain line and a second sensor that senses a higher water level in the balance means in the second gutter, and closes the drain valve, thereby increasing water recirculation capacity for gutter flow at such higher water level.

51. An automated pool perimeter skimming gutter control system comprising, in combination, a water cleaning and recirculation system receiving water from the pool, cleaning it, and returning it to the pool; a first drain line connecting the pool to the water recirculation system for water from the pool for cleaning; a drain valve in the first drain line which when open allows water from the pool to flow to the water recirculation system and when closed stops such flow; a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second drain line connecting the gutter conduit with the water recirculation system for water feed from the gutter for cleaning; at least one surge weir having a weir closure movable between open and closed positions and disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a balance means in flow connection with the first and second drain lines and the water recirculation system receiving pool water via each drain line, blending the pool waters, and flowing the blended waters to the water recirculation system; a first sensor sensing a first water level in the balance means characteristic of a low threshold of pool activity but excessive weir skimming flow, and arranged to close at least one weir closure, and a second sensor sensing a second level in the balance means corresponding to a higher level of pool activity, and arranged to close the drain valve and thereby increase water recirculation system capacity to accommodate such increased overflow, and prevent wash-back from a gutter conduit to the pool.

52. A twin-gutter automated pool perimeter skimming gutter control system comprising, in combination, a water cleaning and recirculation system receiving water from the pool, cleaning it, and returning it to the pool; a first drain line connecting the pool to the water

UNITED STATES PATENT AND TRADEMARK OFFICE

CERTIFICATE OF CORRECTION

PATENT NO. : 4,206,522

DATED : June 10, 1980

INVENTOR(S) : William H. Baker

It is certified that error appears in the above-identified patent and that said Letters Patent are hereby corrected as shown below:

| | |
|---|---|
| [56] last line : | "Van den Brock" should be --Van den Broek-- |
| Column 2, line 37: | after "such" insert --as--. |
| Column 12, line 1: | "sweimming" should be --swimming--. |
| Column 20, line 30: | "drive" should be --drain--. |
| Column 28, line 39: | "correct" should be --course--. |
| Column 29, line 36: | "draim"should be --drain--. |
| Column 31, line 10: | "to" should be --for--. |
| Column 31, line 44: | "through" should be --trough--. |
| Column 35, line 38: | "therwithin" should be --therewithin--. |

Signed and Sealed this

Tenth Day of November 1981

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,206,522

DATED : June 10, 1980

INVENTOR(S) : William H. Baker

It is certified that error appears in the above-identified patent and that said Letters Patent are hereby corrected as shown below:

| | |
|---|---|
| [56] last line : | "Van den Brock" should be --Van den Broek-- |
| Column 2, line 37: | after "such" insert --as--. |
| Column 12, line 1: | "sweimming" should be --swimming--. |
| Column 20, line 30: | "drive" should be --drain--. |
| Column 28, line 39: | "correct" should be --course--. |
| Column 29, line 36: | "draim"should be --drain--. |
| Column 31, line 10: | "to" should be --for--. |
| Column 31, line 44: | "through" should be --trough--. |
| Column 35, line 38: | "therwithin" should be --therewithin--. |

Signed and Sealed this

Tenth Day of November 1981

[SEAL]

*Attest:*

GERALD J. MOSSINGHOFF

*Attesting Officer*

*Commissioner of Patents and Trademarks*